US006502963B1

(12) United States Patent
King

(10) Patent No.: US 6,502,963 B1
(45) Date of Patent: Jan. 7, 2003

(54) FLOOD LIGHT OR LUMINAIRE CONSTRUCTION

(75) Inventor: Jeffrey David King, Carlingford (AU)

(73) Assignee: Walter Wadey & Co. PTY Ltd., Condell Park NSW (AU)

( * ) Notice: Subject to any disclaimer, the term of this patent is extended or adjusted under 35 U.S.C. 154(b) by 0 days.

(21) Appl. No.: 09/284,360

(22) PCT Filed: Oct. 8, 1997

(86) PCT No.: PCT/AU97/00677

§ 371 (c)(1),
(2), (4) Date: Jun. 11, 1999

(87) PCT Pub. No.: WO98/17944

PCT Pub. Date: Apr. 30, 1998

(30) Foreign Application Priority Data

Oct. 18, 1996 (AU) ..... PO3092
Oct. 31, 1996 (AU) ..... PO3363

(51) Int. Cl.[7] ..... F21V 7/06
(52) U.S. Cl. ..... 362/297; 362/346; 362/347
(58) Field of Search ..... 362/296, 297, 362/304, 341, 346, 347, 217, 219, 223, 224

(56) References Cited

U.S. PATENT DOCUMENTS

| | | | | | |
|---|---|---|---|---|---|
| 1,661,077 | A | * | 2/1928 | Marsat | 362/217 |
| 4,194,234 | A | * | 3/1980 | Geissler | 362/217 |
| 4,386,824 | A | * | 6/1983 | Draper | 362/346 |
| 4,899,261 | A | * | 2/1990 | Blusseau et al. | 362/297 |
| 5,032,958 | A | * | 7/1991 | Harwood | 362/217 |
| 5,067,053 | A | * | 11/1991 | Akizuki | 362/297 |
| 5,305,189 | A | * | 4/1994 | Sekiguchi | 362/297 |
| 5,313,379 | A | * | 5/1994 | Lemons et al. | 362/346 |
| 5,361,193 | A | * | 11/1994 | Nino | 362/346 |
| 5,515,255 | A | * | 5/1996 | Nielson et al. | 362/297 |
| 5,544,030 | A | * | 8/1996 | Wijbenga | 362/297 |
| 5,647,661 | A | * | 7/1997 | Gordin | 362/346 |

FOREIGN PATENT DOCUMENTS

| | | | | |
|---|---|---|---|---|
| DE | 662096 | | 7/1938 | |
| DE | 717962 | | 2/1942 | |
| DE | 3127250 | | 1/1981 | |
| DE | 3436778 | | 8/1985 | |
| EP | 0084934 | * | 8/1983 | 362/346 |
| GB | 2106625 A | * | 4/1983 | |
| RU | 1802861 | | 3/1993 | |

* cited by examiner

*Primary Examiner*—Alan Cariaso
(74) *Attorney, Agent, or Firm*—Mark R. Wisner

(57) ABSTRACT

The present invention relates to luminaries or floodlights and more particularly to reflectors for such floodlights. The present invention is embodied in a reflector that has the one or more of the following features: a combination of two or more different types of reflecting sheet; spectral sheet in a band in a central portion of the reflector; concentrating or concave peened reflecting sheet in a band in a central portion of the reflector; three different parabolic curves forming the reflector all having a common focal line; a visor.

26 Claims, 9 Drawing Sheets

2
57
6
4
8
10
6
20
6
43
41

FLOOD LIGHT OR LUMINAIRE CONSTRUCTION

FIELD OF THE INVENTION

The present invention provides a reflector for a flood light or luminaire which can be utilised for flood lighting purposes.

BACKGROUND OF THE INVENTION

When in use, area luminaire products also known as flood lights, can exhibit one or more of the following disadvantages.

Hot spots ("hot spot" is a term used to designate areas of light concentration) can occur on the ground being lighted by floodlights. The unevenness produced in the area lit by one flood light is produced by variable amount of light falling on the surface area to be lighted. In lighting installations for security and other purposes, this problem can be overcome by provision of many lights lighting a particular area, all being directed so that adjacent and opposite flood lights will "fill in the gaps" or even out the amount of light over the total area. Such additional lights can result in high additional costs because of the need for more light fittings, additional cable laying and control systems; and higher operating costs for the owners.

Another disadvantage which may be exhibited by lighting systems in the market place is that the cut off, ("cut off" is a term referring to the clear division between lighted and non-lighted areas which prevents light falling on areas on which light is not required), is not sufficient to meet increasing standards for cut off from lighted installations as described in Australian standard 4282.

Another disadvantage of flood light construction of the prior art is that they are designed for use with a particular lamp, but when the lamps are improved and new and better lamps enter the market, the reflectors are not able to work as originally designed with the new lamps. Once the older globes are no longer in the market place, the reflectors and light fittings may need to be replaced because they no longer work as designed with new technology lamps.

Prior art luminaires in achieving the cut off demands for lighted installations detailed in AS4282 have, to date, not been able to produce a distribution of light that would look substantially even to the naked eye, over the lighted area, from a single lamp, without the assistance of additional lighting products.

This standard in Australia, and a similar standard in Europe and other countries, will become more important as environmental limitations, such as the prevention of unwanted light from spot lights falling into residential areas, farming or other areas, become more enforceable in Australia and other jurisdictions.

It is an object of the present invention to provide a reflector and or a flood light which ameliorates, at least in part, at least one of the disadvantages of the prior art.

SUMMARY OF THE INVENTION

The present invention provides a reflector having at least three segments, each segment having a part parabolic shape in cross section or side elevation, all segments having the same cross section across a major portion of their width with a common focal line, said segments having a common focal point located on said focal line at approximately the midpoint of said focal line, said parabolic segments being able to reflect a parallel beam of light that originates from a source located at said focal point or along said focal line.

The present invention provides a reflector having a parabolic portion or more than one part parabolic portions which includes at least a first portion having a specular reflecting sheet and a second portion having a concentrating or concave peened reflecting sheet, said first portion occupying an area of said reflector which area is located intermediate of the width of said reflector and said second portion occupying an area adjacent to said first portion said second portion also being located intermediate of the width of said reflector, said parabolic or part parabolic portions having a focal point at which point the centre of a lamp is positionable, said focal point being at a minimum focal distance from said parabolic portion or one of said part parabolic portions, said minimum distance defining a focal length of the parabolic portion or one of said part parabolic portions, said reflector terminating at a rim which is contained in a single plane.

The present invention also provides a flood light including a main reflector surface and two side reflectors, said main reflector surface having at least two part parabolic portions, a first part parabolic portion being made from a specular reflecting sheet and a second part from concentrating or concave peened reflecting sheet each of said reflecting sheet positioned centrally of said reflector surface, said first part parabolic portion occupying the area of from a rim of said main reflector to a first intermediate location of said main reflector surface and said second part parabolic portion occupying an area from said first intermediate location to a second intermediate location, each part parabolic portion being characterised by having a common focal point at which the centre of a small arc metal halide lamp or other small arc lamp is positionable, wherein the smallest focal length part parabolic portion is that portion which is includes all of the specular reflective sheeting, with said first and second part parabolic portions including said concentrating or concave peened reflective sheeting, said main reflector surface having the following dimensional features:

a) the parabolic distance occupied by said specular reflecting sheet on said parabolic portion or part parabolic portion is some 3.8 times said smallest focal length;

b) the parabolic distance occupied by said concentrating or concave peened reflecting sheet is some 3.4 times said smallest focal length;

c) the width of the specular reflecting sheeting and the width of said concentrating or concave peened reflective sheeting is the same and is approximately 3 times the smallest focal length;

d) the perpendicular height of said reflector above a plane which includes a rim of said reflector, is approximately 4.8 times said smallest focal length;

e) the width of the opening of said reflector at its rim is some 9.6 times said smallest focal length;

f) the perpendicular distance between a line perpendicular to the plane of said rim which perpendicular line is tangent to said reflector at the reflector's left hand extremity and a second line which is parallel to said perpendicular line through the right hand extremity of said reflector, is some thirteen to fourteen times said smallest focal length of said parabolic portion;

g) the length of the opening of the reflector from its forward rim to its rearward rim is 12.9 times said smallest focal length; and wherein said first part parabolic portion is contoured and oriented to provide a main beam emitted in a direction of 55 to 65 degrees to a direction normal to the plane of said rim and said second part parabolic portion is contoured and oriented to provide a main beam emitted in a direction 45 to 55 degrees to a direction normal to the plane of said rim, said flood light including a visor which when light from said lamp hits it at some 50 to 65 degrees to a direction normal to the plane of said rim, said visor will reflect light, and wherein the rest of said main reflector surface and said side reflector is comprised of spreading or convex peened reflecting sheet.

The present invention further provides a reflector surface having a first, second and third part parabolic portions having a common focal line, said first part parabolic portion having the smallest focal length and beginning at one rim, the third part parabolic portion having the longest focal length and terminating at a rim opposite said first mentioned rim, said first and third part parabolic portions being connected by said second part parabolic portion having a focal length intermediate the focal length of said first and third part parabolic portions, the change over from said first part parabolic portion to said second part parabolic portion occurring at an angle of some 0 to 10 degrees to the vertical measured at the common focal point or line, and the changeover from said second part parabolic portion to said third part parabolic portion occurring at some 50 to 80 degrees to the vertical measured at the common focal point or line; said first part parabolic portion reflecting a main beam at an angle of between some 55 to 65 degrees from the vertical, said second part parabolic portion reflecting a main beam at an angle of some 45 to 55 degrees from the vertical, and said third part parabolic portion reflecting a main beam at an angle of some 25 to 45 degrees from the vertical, each of said change over between adjacent part parabolic portions being such that tangents to adjacent part parabolic portions at their theoretical point of intersection have an angle between the tangents of between 0° and 5°.

The present invention also provides a floodlight having a reflection surface formed from three parabolic segments and two reflective sides, said flood light including a visor to reflect light from said visor onto said reflection surface, said flood light being characterised by having 3 main beams reflected from a light source off each of the parabolic segments and fill light directly from said light source, and wherein additional fill light is provided by means of light reflected from said visor subsequently being reflected from said parabolic segments and out through said visor, said flood light producing defined cut offs in at least the forward and rearward directions.

A flood light or luminaire containing a reflector which is an embodiment of the above inventions can produce an improved distribution of light in the area lit by the flood light, and yet maintain a level of cut off which allows the lighted installation to meet the demands of AS4282 or similar standards.

An illuminance, which to the naked eye will appear more uniform than that produced by the prior art, occurs from directly below the flood light out to 60 degrees from the vertical and within or along an arc of 60 degrees from directly below the flood light in the horizontal plane.

These features may result in less light fittings and lamps being utilised to light up a desired area by comparison with prior art constructions, together with a corresponding reduction in the amount of cabling, controls and labour and operating costs for installation of all this equipment.

The above definitions of the inventions are directed to features, which at the time of writing are thought to be essential to those inventions. At a later date, it may be necessary to combine with those essential features, features which are at this time inessential features or are indicated as being preferable, so that currently inessential or preferable features in combination with essential features identified above, will result in an invention or invention differentiated from prior art, which may come to light at a later time.

BRIEF DESCRIPTION OF THE DRAWINGS

An embodiment of the invention will now be described, by way of example only, with reference to the accompanying drawings.

DETAILED DESCRIPTION OF THE EMBODIMENTS

Figure 1:
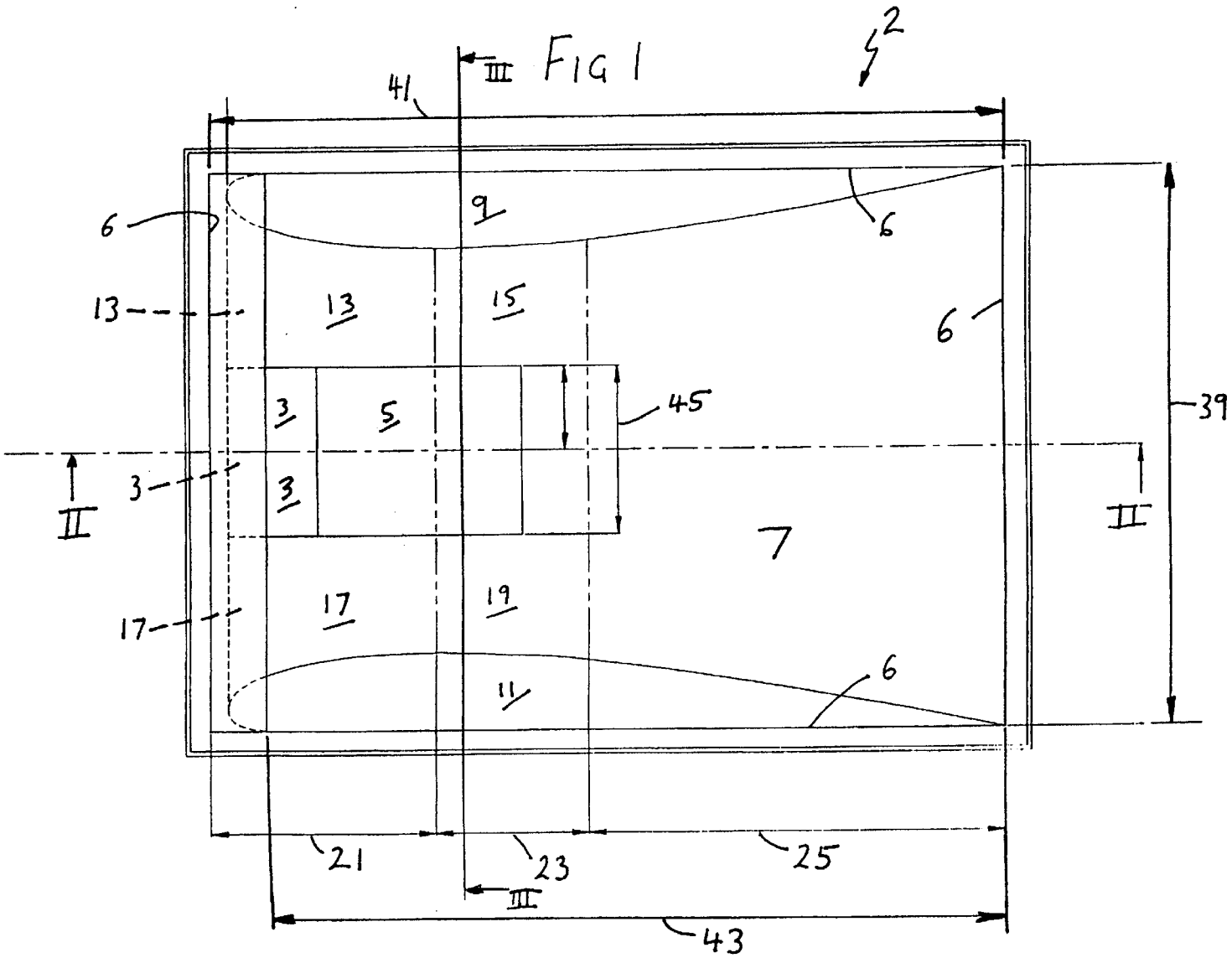
FIG. 1 is an underneath plan view of a flood light according to the present invention.
Figure 2:
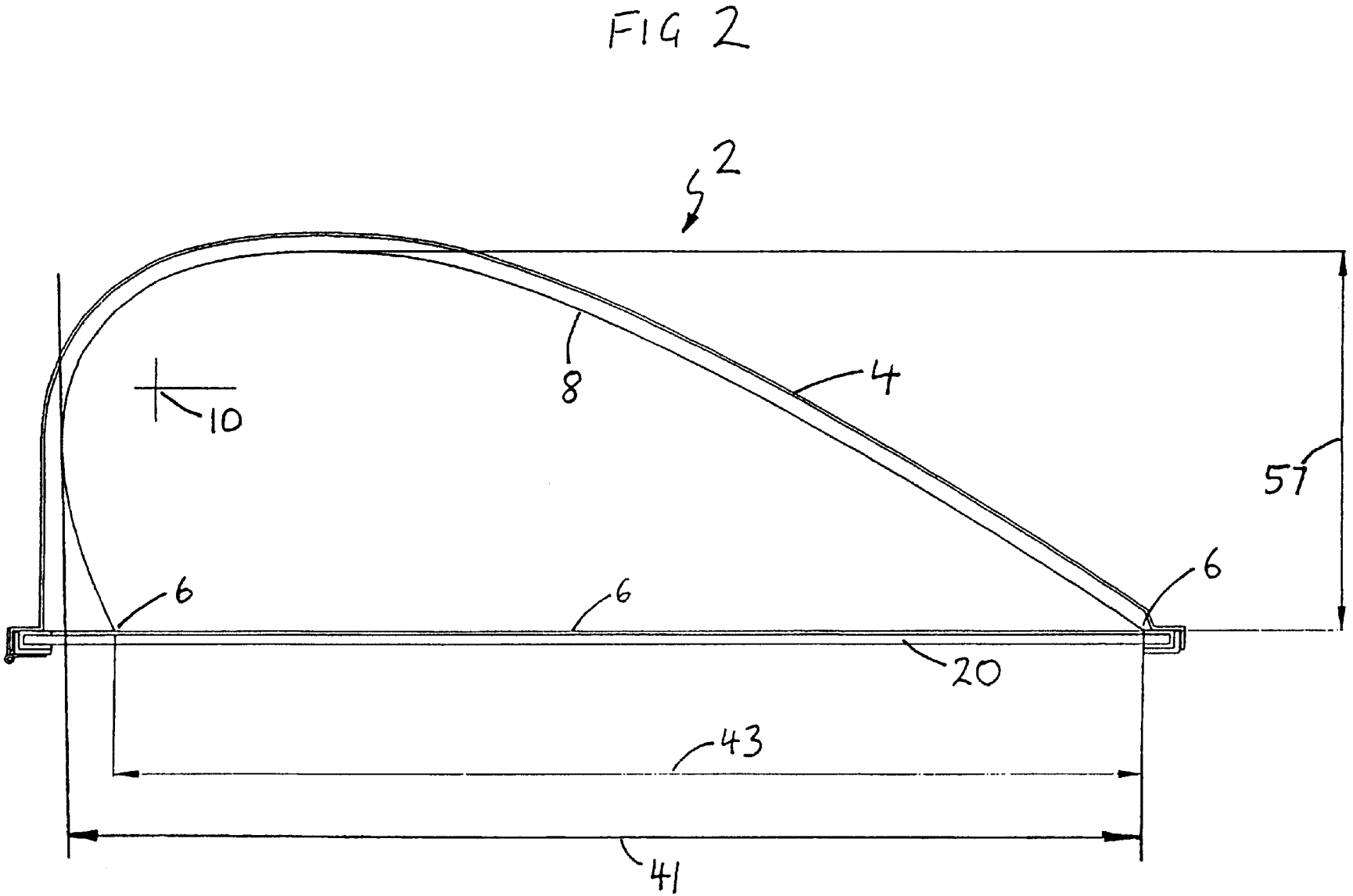
FIG. 2 is a cross section through the apparatus of FIG. 1 along line II—II.
Figure 3:
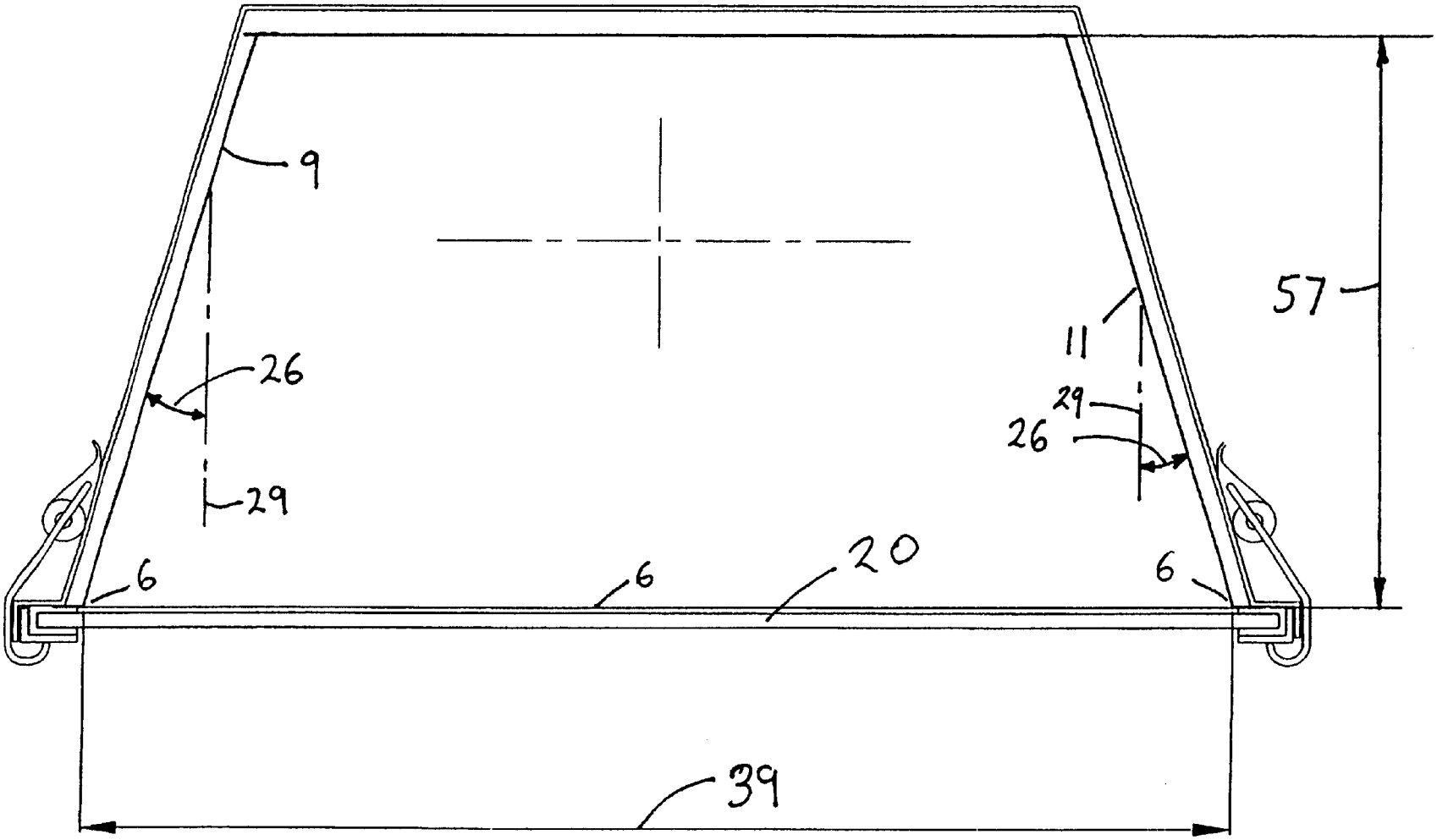
FIG. 3 is a cross section along the line III—III of FIG. 1.
Figure 4:
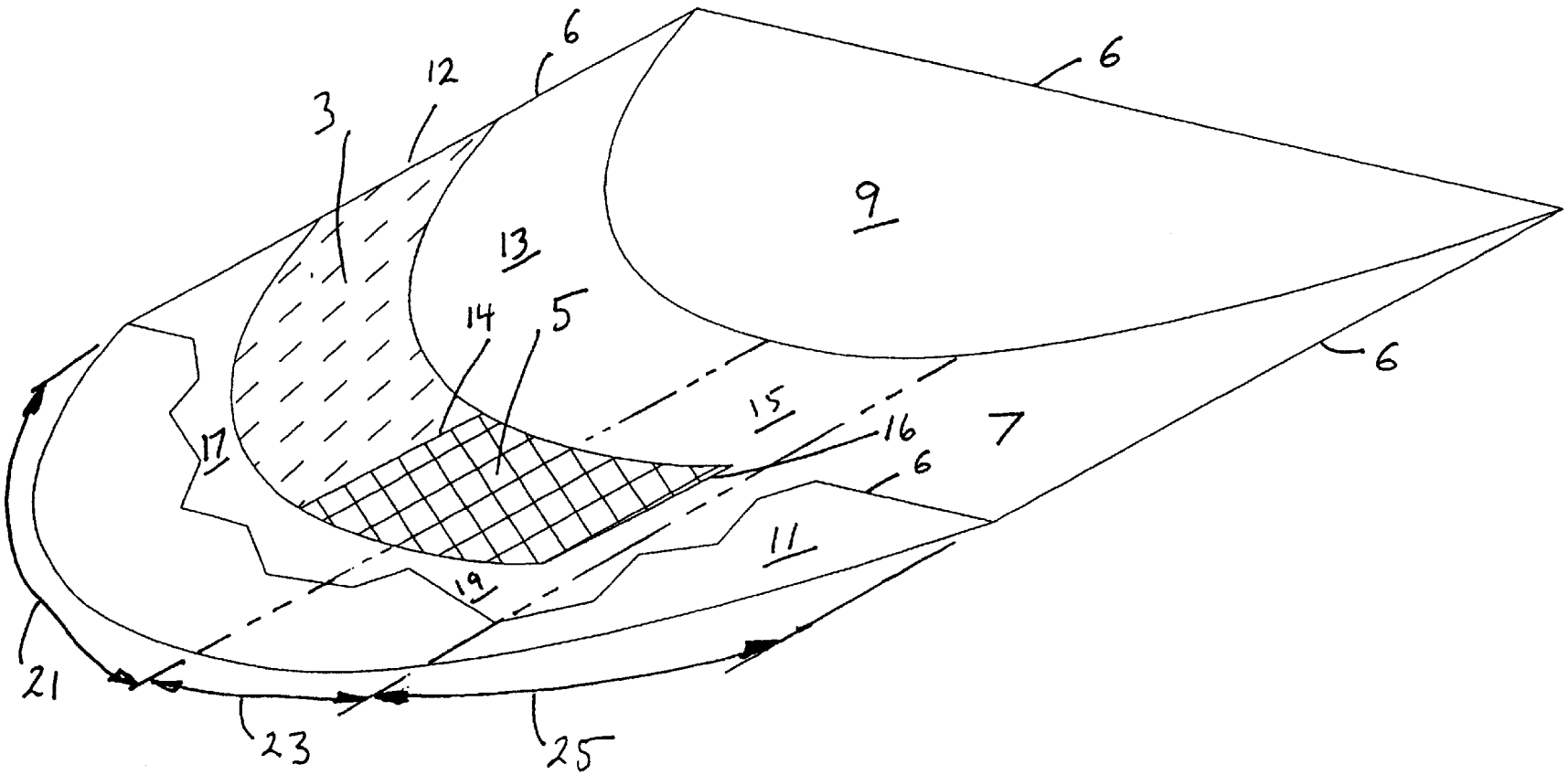
FIG. 4 is a cut a away perspective view of an inverted reflector of the flood light of FIGS. 1 to 3.

Illustrated in FIGS. 1 to 3 is cut off type flood light 2 and FIG. 4 illustrates details of its main reflector 8 which has three parabolic sections and two side reflective planar panels. The flood light 2 has an integrally formed or fabricated outer body 4 and a rim 6 located in a single plane to receive a glass or plastics visor 20 which is better illustrated in FIG. 3. The cut off type flood light 2 of the figures is in cross section substantially of a half tear drop shape, wherein the rear end is the thick end of the half tear drop shape and the forward end is the thin end of the half tear drop shape. In the longitudinal cross section of FIG. 2 the half tear drop shape is illustrated.

Figure 6:
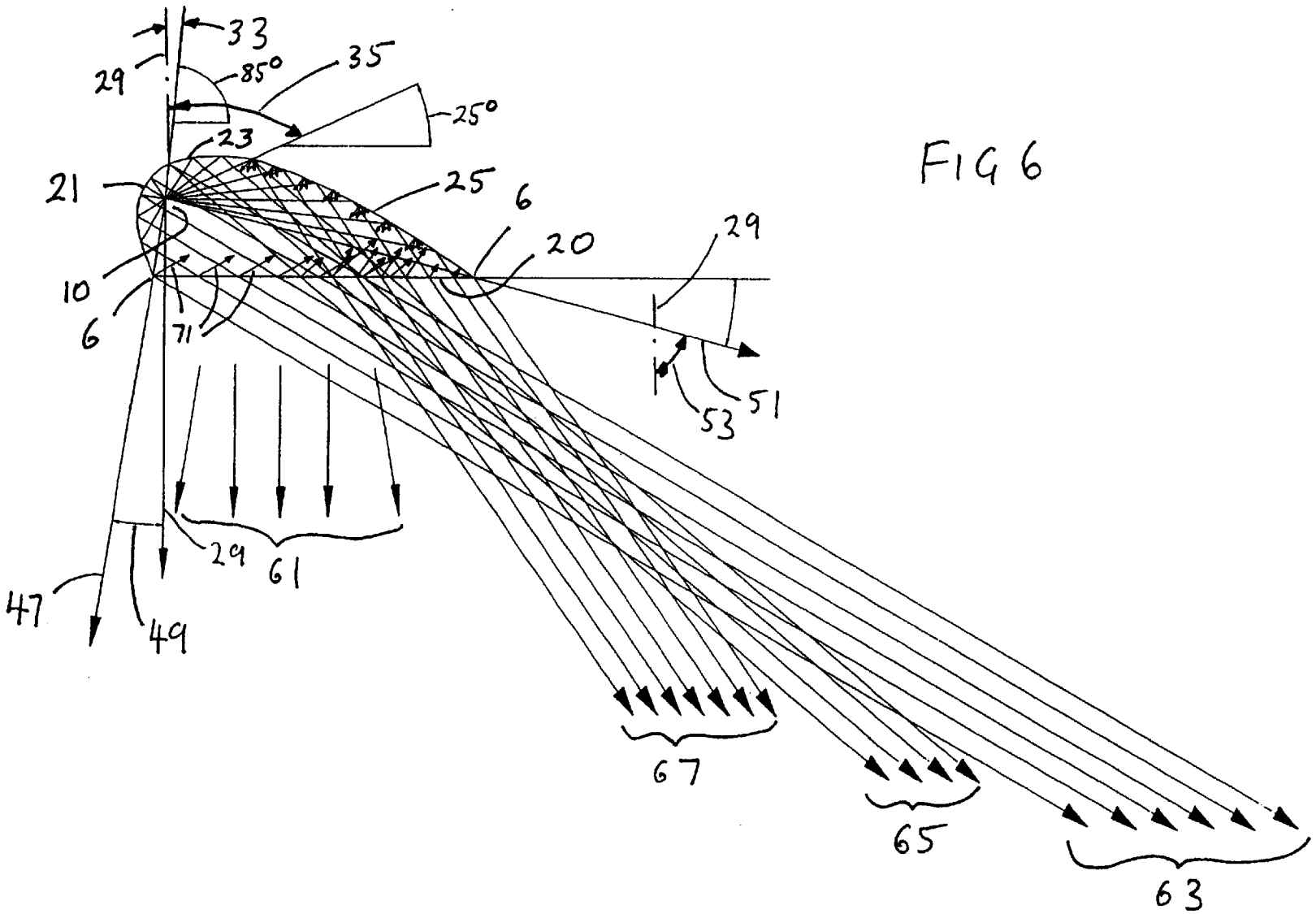
FIG. 6 is a schematic of the direction of light passing through a visor and reflected by the reflector of FIG. 4.
Figure 7:
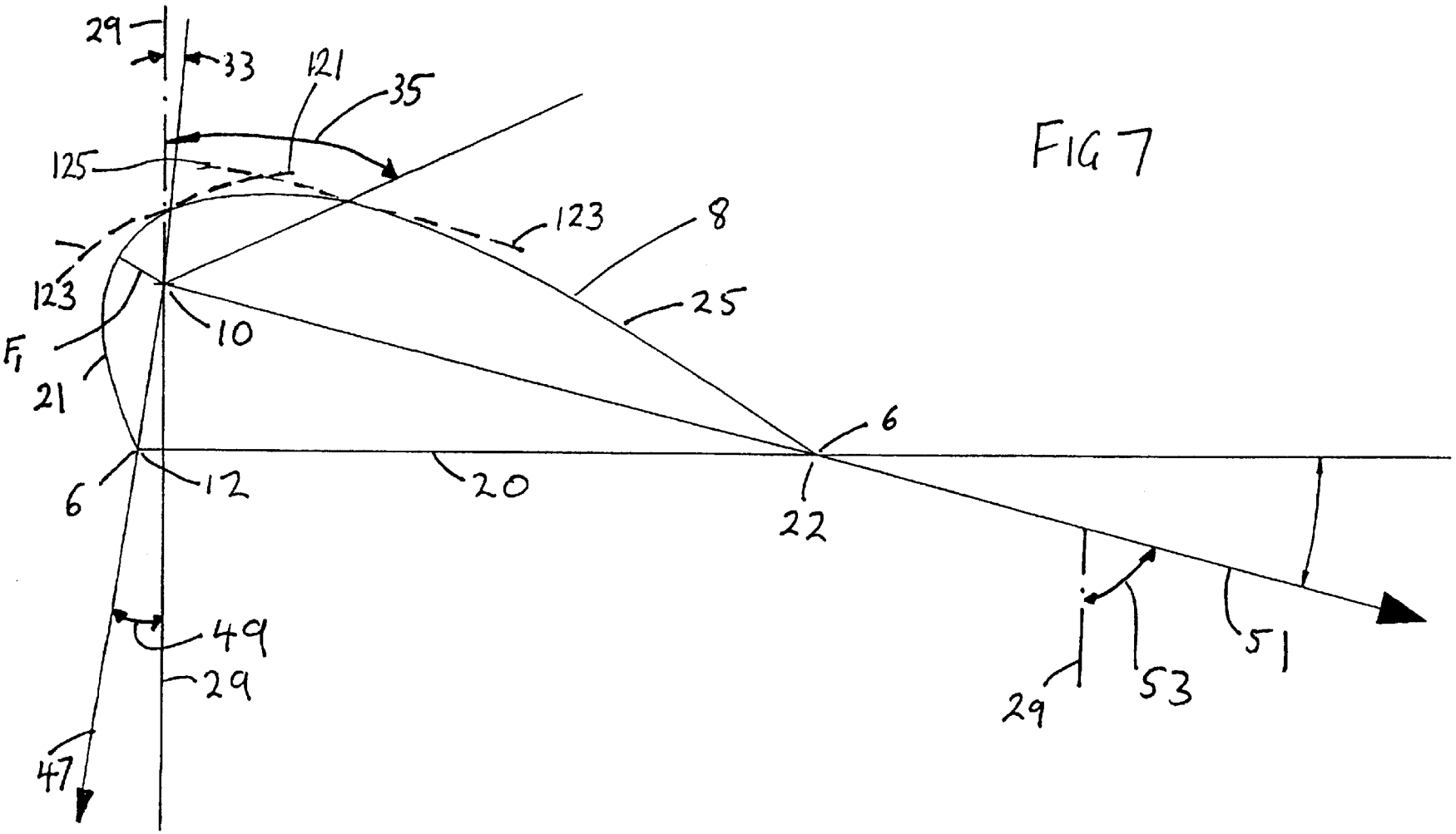
FIG. 7 is a further depiction of the reflector of FIG. 4 showing the blending points, definitions of the focal lengths and the directions of the respective beams.

Referring now to FIGS. 6 and 7, the reflector 8, has three part parabolic portions being segments 21, 23 and 25. The parabolic segments have a common focal line for the purpose of the drawing, construction or formation of the parabolic segments. However, this focal line becomes a focal point when the reflector is viewed in cross section from a side elevation. A lamp, if it is classified as a point source, is located at a point which is the mid point of the focal line. For convenience this point will be hereinafter referred to as the focal point. Lamps with an extended or long arc are positioned so that the arc is as close as possible to being coincident with the focal line, and centred about the focal point. The focal point referred to below is not a true focal point in the sense of a truly circular parabolic reflector, that is a reflector produced by revolution of a parabola. But the reflector in cross section does have segments which are part parabolic in shape.

The segment 21 begins at the rim 6 on one side of the main reflector surface 8 and continues until there is a change over to segment 23. Segment 23 also continues until there is a change over to segment 25 which terminates at an opposing rim opposite to the rim at which segment 21 begins. At the points of change over the radii of curvature are blended so as to obtain a relatively smooth interchange.

The change over from segment 21 to segment 23 occurs at an angle 33 which is of 5 degrees to the vertical 29 measured at focal point 10, and measured from the vertical 29 starting above the focal point 10 and measuring in a clockwise direction. The most accurate depiction of this arrangement is illustrated in FIGS. 6 and 7.

The change over segment 23 to segment 25 occurs at an angle 35 which is of 65 degrees from the vertical 29 measured at the focal point 10, and measured from the vertical 29 starting above the focal point 10, and measuring in a clockwise direction. The most accurate depiction of this arrangement is illustrated in FIGS. 6 and 7.

The parabolic segment 21, 23 and 25, at their theoretical point of intersection of adjacent segments are such that the two tangents to the respective adjacent parabolas at the point of intersection have an angle between the two tangents of 3 to 4 degrees, but may be in the range of 0 degrees to 5 degrees. This ensures a smooth transition or change over between the adjacent parabolic segments. The change over locations are preferably radiused on either side of the theoretical point of intersection for a distance of approximately 2.5 to 5 degrees measured either side of the theoretical point of intersection, with the 2.5 to 5 degrees being measured from the common focal point 10 of the parabolic segments 21, 23 and 25. The forming of a radius at the change over locations helps to ensure that no striations (which are areas of high and low intensities and light distributions) form on the lighted surface.

Figure 5:
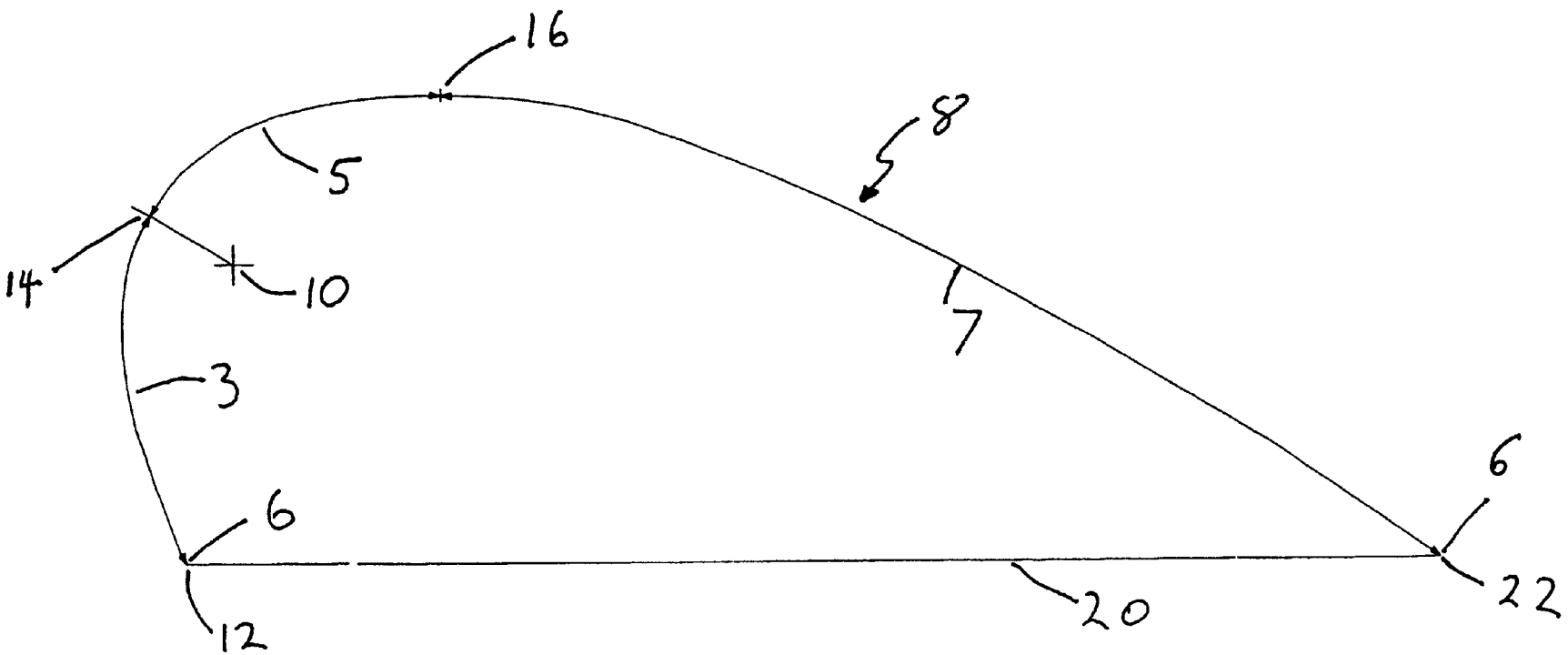
FIG. 5 is a schematic of the internal profile of the reflector of FIG. 4, detailing the different reflecting finishes.

The parabolic segments 21, 23 and 25 have a common focal point 10 indicated in FIGS. 5, 6 and 7. Whereas each of the segments 21, 23 and 25 have a differing focal length. The focal length of the segment 21 (which is also the shortest focal length) is designated by $F_1$ in FIG. 7, which for convenience will be given the pronumeral A. The focal length of segment 23 is 1.11 times $F_1$, ($1.11\times F_1$ or $1.11\times A$) and the focal length of segment 25 is 1.58 times $F_1$($1.58\times F_1$ or $1.58\times A$).

The segment 21 is oriented so as to direct a main beam 63 at an angle of 60 degrees to the downward vertical 29 measured from and through the common focal point 10. Segment 23 is oriented so as to direct a main beam 65 at an angle of 50 degrees to the downward vertical 29 measured from and through the common focal point 10. Segment 25 is oriented so as to direct a main beam 67 at an angle of 35 degrees to the downward vertical 29 measured from and through the common focal point 10.

The preferred embodiment of the flood light 2 has an internal profile of specific dimensions. The reflecting surfaces change at positions which are not dependent on the tri-parabolic portion of main reflector surface 8. The following parabolic distances and the dimensions of the reflector will now be specified by reference to a multiplication factor of the focal distance A (which can be substituted by dimension $F_1$ if desired, because they are equal):

(1) As illustrated in FIG. 4 the parabolic length of curvature area 3 from line 12 to line 14 (or shown in cross section as point 12 and point 14 in FIG. 5) of approximately 4.1 times the focal length A ($4.1\times A$);

(2) As illustrated in FIG. 4, the parabolic length of curvature of area 5 from line 14 to line 16 of FIG. 4 (or shown in cross section as point 14 and point 16 in FIG. 5) is of a length of approximately 3.1 times the focal distance A ($3.1\times A$);

(3) As illustrated in FIG. 1 or 3, the width 39 of the opening of main reflector surface at the rim 6 at which segment 25 terminates, and the maximum distance apart of the side reflectors 9 and 11 at their lower rim, and the width of the opening at rim 6 at which segment 21 begins, are each equal and a distance of approximately 9.6 times the focal length A ($9.6\times A$).

(4) As illustrated in FIG. 1 or 2, the longitudinal length 41 of the main reflector surface 8 is preferably 13.6 times the focal length A($13.6\times A$). The longitudinal length 41 is the perpendicular distance measured between a line which is perpendicular to the plane of the rim 6 which makes a tangent to the left hand extremity of the reflector (located along portion 3 between point 12 and between point 14) to a line parallel to the perpendicular line passing through point 22 at the end of segment 25 on rim 6.

(5) As illustrated in FIGS. 1 and 2, the length 43 of the main reflector opening measured from the front rim to the back rim is 12.9 times the focal length A ($12.9\times A$).

The tri-parabolic main reflector surface 8 does not have the same reflecting sheeting finish all across its width. Three different surface finishes are utilised.

The area 3 of FIGS. 1 and 4, is positioned, attached to, or constructed along the parabolic contour of segment 21, from a specular finish reflecting sheet generally manufactured from aluminium of the type sold under the trade mark ANO-COIL: (catalogue number 715.30).

The area 5 of FIGS. 1 and 4, is positioned, attached to, or constructed along the parabolic contour of segment 23, from a large hammered concave reflecting sheet generally of aluminium which is a concave peened or concentrating reflecting sheet, sold under the brand ANO-COIL (catalogue number 211.33).

The areas 3 and 5 are centrally positioned with respect to the width 39 of the reflector 8. That is the centre lines of the areas 3 and 5 are coincident with the centre line through the reflector perpendicular to width 39, which also halves width 39.

The areas 3 and or 5 can be formed in the reflector 8 by the method of substituting an area of reflector 8 with an insert having the reflective sheeting of areas 3 and or 5. The insert being contoured to the parabolic shape or shapes which correspond with the location of the areas 3 and or 5. Another method is to simply attach the pre contoured reflective sheeting of areas 3 and or 5 by any known means such as riveting. This latter method will lessen the focal distance of the area 3 and or 5 from the focal point 10, but only minutely, without disrupting the operation of the reflector 8. If desired the area 3 can be attached by a different means to that of area 5.

The rest of the areas are as follows: 13 and 17 follow the contours of segment 21; areas 15 and 19 follow the contour of segment 23; the area 7 follows the contour of segment 25; and all the areas of the side reflectors 9 and 11 (each of which is illustrated in FIG. 1) are all constructed from or coated or overlaid with small hammered convex reflecting sheet generally of aluminium which is a spreading or convex peened reflecting sheet sold under the brand name ANO-COIL (catalogue number 217.33).

While a particular brand of specular, concave peened and convex peened reflecting sheet is described, other brands of reflecting sheets can be used, providing they meet the same specification of reflecting sheet associated with those specific products above. Also while aluminium is the material chosen for this embodiment, any appropriate material or combination of materials which function with the same reflectivity of the same peen sizes will be satisfactory.

The large hammered concave or concentrating or concave peened reflective sheeting referred to above is of an average of 1 square centimetre in area, for each peen formation. Whereas for the small hammered spreading convex peened aluminium reflecting sheet, the surface area of each peen is an average one half of a square centimetre for each peen formation. Other sizes, shapes or types of peen formation may also work, but the types of reflective sheeting available in Australia are relatively limited, and the results of the specified reflective sheeting are known at this time to provide the advantages of the invention, when used as described.

The width 45 of the areas 3 and 5 of FIGS. 1 and 4 are about 3 times the focal length A(3×A). The width of 3 times focal length A has been identified as being the minimum width of areas 3 and 5 to produce improved results in cut off. The current availability of reduced arc metal halide lamps, is thought to limit the width used to no greater than 3.5 times A, otherwise with such lamps the additional surface area available to reflect light is thought to reflect light in directions which reduce the cut off capability of the flood light 2. However, the width 45 is preferably in the range of 2.5A to 3.5A. This dimension is dependent on the characteristics of the lamp.

A glass or plastics visor 20, is positioned into the outer body 4 adjacent the rim 6. The visor 20 is separated from the rim 6 by a small distance to allow for gasketing of the visor 20 with the body 4. This distance should be kept to a minimum, otherwise the reflective characteristics of the visor and the interaction with the reflector 8 will not be as designed. The visor 20 is represented in FIG. 3 as connecting the point 12 to the point 22. The visor 20 sits adjacent to the rim 6 and seals in the reflector 8 relative to the outer body 4.

Figure 8:
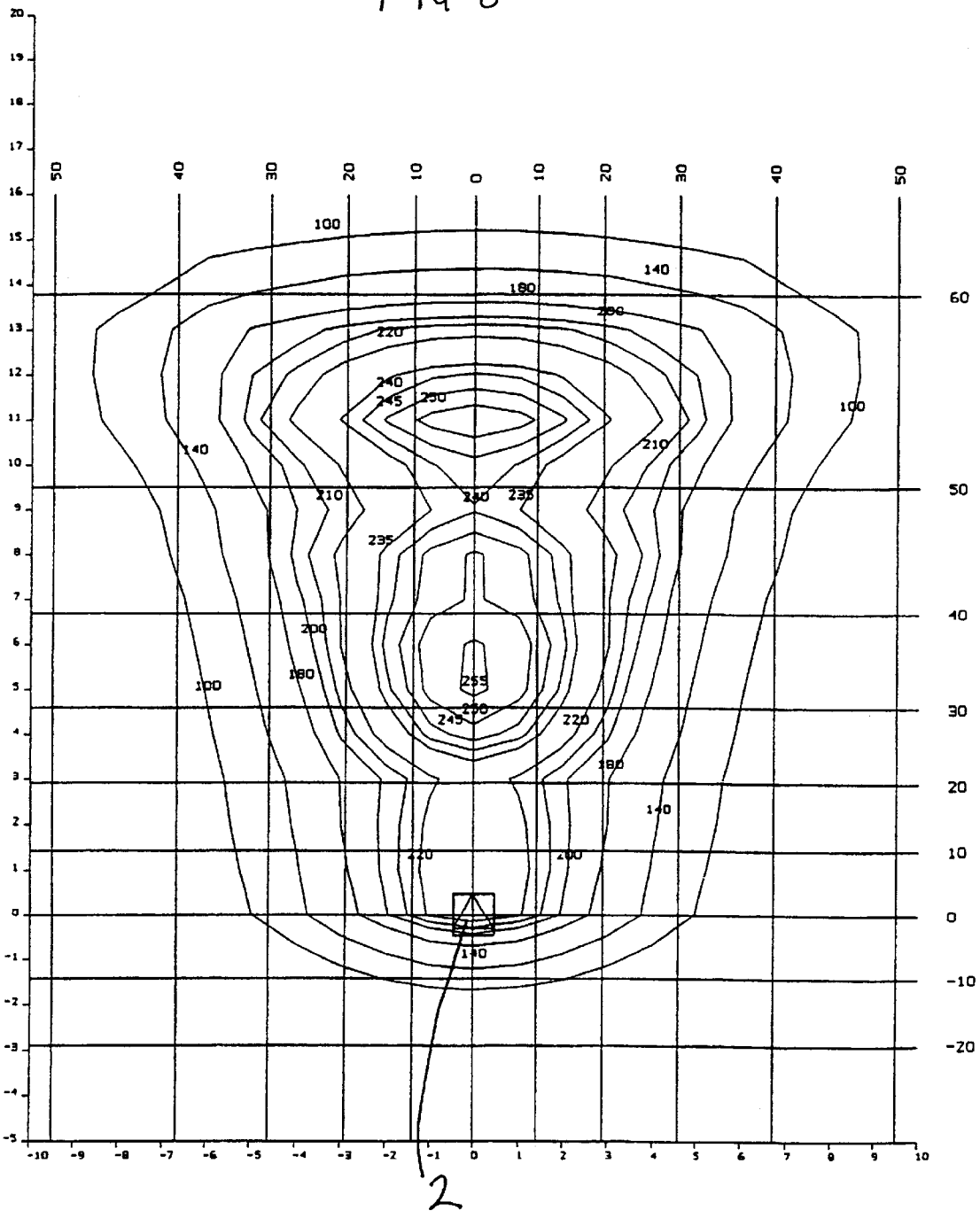
FIG. 8 is an isolux map of the light produced by a floodlight having a reflector of the invention.

Light internally reflected off the visor 20 as illustrated in FIG. 6 is utilised in combination with the reflector to create the fill in light indicated in FIG. 6. It is one of the factors which can contribute to the relatively even illumination result on the horizontal plane as illustrated in FIG. 8.

The cut off performance of the flood light 2 is graphically represented in FIGS. 6 and 7. The rear cut off 47 at the rim designated by point 12 in FIG. 5, is illustrated in FIG. 7 as being at an angle 49 of approximately 10 degrees from the downward vertical 29, measured at point 12, from the lower end of a vertical line, measured in a clockwise direction. Whereas on the rim of the segment 25, represented by point 22 in FIG. 5 the forward cut off 51, is shown in FIG. 7 to be at an angle 53 of approximately 75 degrees from the vertical 29 measured at point 22, from the lower end of a vertical line, measured in an anticlockwise direction.

The cut off produced at the sides of the flood light 2 is dependent upon a combination of the angle 26 of the side reflectors 9 and 11 to the vertical 29 as depicted in FIG. 3 and the depth 57 of the side reflectors 9 and 11. The angle 26 of the side reflectors 9 and 11 is preferably 16.5 degrees to the vertical 29. The depth 57 of the side reflectors 9 and 11 is preferably a height of 4.8×A.

Depending upon the space and the desired amount of light needed to fall on the deemed space, the flood light 2 can be raised or lowered to any desired position as would be used in a normal lighting situation, without substantially affecting the evenness of illuminance.

The light from the flood light 2, because of the features above, will be emitted and fall onto the surface to be lighted, in a relatively even fashion by comparison to the prior art, irrespective of the mounting height of the flood light 2 (providing it is mounted in a horizontal attitude for cut off purposes). The horizontal attitude is defined by the surface of the visor 20 being in the horizontal plane relative to the direction of gravity.

It is expected that the cut off type flood light 2 depicted and described above, will have an illuminance variation of between 5% and 20% across the surface area being lit. This range of variation in illuminance will, in the main, be relatively difficult to detect with the naked eye. The variation in illuminance is measured from readings taken out to 60 degrees from the vertical 29 (through the focal point) and within an arc of 60 degrees from directly below the flood light in the horizontal plane.

The variation of illuminance is reduced to the levels mentioned above because the segments 21, 23, 25 areas 3, 13, 17, 5, 15, 19, 9, 11, 7 together with the reflective effects of the visor 20 and the type of lamp used as mentioned above produces light beam sources as indicated in FIG. 6. Between the forward and rear cut offs 51 and 47 respectively in FIG. 6 direct light (not illustrated) which is that light which travels out of the flood light 2, in a direct path from lamp located at the focal point 10. However, additional light in the form of dispersed fill light 61 supplements the direct light (not illustrated). The dispersed fill light 61 originates as light 71 which is reflected from the visor 20 internal surfaces, which subsequently strikes the reflector's segments 25, 23 and 21, and projects out of the floodlight 2 in a direction between rear cut off 47 and forward cut off 51.

The positional relationship between the visor 20, the lamp and the reflector 8, in particular the parabolic segment 25, is such that this dispersed fill light will result from the reflection of some 33% of the light which strikes the visor 20 at an angle of around 50 to 65 degrees to the direction which is normal to the visor 20. The location, orientation and length of the parabolic segment 25 is such that most of the light reflected off the parabolic segment 25 will remain within the rear cut off 47.

It is expected that a flood light, constructed from the above features, in the following dimensional ranges, is capable of producing similar results to the preferred embodiment mentioned above. Those dimensions are:

(1) the parabolic length of curvature (see FIG. 4) of the area 3 is in the range of 3.3×A to 4.5×A, (2) the width 45 of areas 3 and 5 (see FIG. 4) is in the range of some 2.5×A to 3.5×A (3) the parabolic length of curvature (see FIG. 4) of area 5 is between 2.8×A and 4.1×A;

(4) the angle of the main beam 63 (see FIG. 6) produced by segment 21 is between 50 and 65 degrees measured from the vertical 29;

(5) the angle of the main beam 65 (see FIG. 6) produced by segment 23 is between 45 and 55 degrees measured from the vertical 29;

(6) the angle of the main beam 67 (see FIG. 6) produced by segment 25 is between 25 and 45 degrees measured from the vertical 29;

(7) the side reflectors 9 and 11 make an angle 26 to the vertical 29 (see FIG. 3) of some 15 to 18 degrees.

(8) the angle 33 (see FIG. 6) at which change over occurs between segment 21 and segment 23 is between 0 and 10 degrees from the vertical 29 measured at the focal point 10 and measured from above the vertical 29 in a clockwise direction;

(9) the angle 35 (see FIG. 6) at which change over occurs between segment 23 and segment 25 is between 50 and 80 degrees from the vertical 29 measured at the focal point 10 and measured from above the vertical 29 in a clockwise direction;

(10) the maximum height 57 (see FIGS. 2 and 3) of said reflector 8 above a rim 6 wherein the rim 6 is in a single plane, is in the range of 4.3×A to 5.3×A;

(11) the width 39 (see FIGS. 1 and 3) of the opening of the reflector at the rim is some 9.1×A to 11×A;

(12) the length 43 (see FIGS. 1 and 2) of the opening of the reflector measured at the rim is 12×A to 13.5×A

(13) the length 41 (see FIGS. 1 and 2) of said reflector from the left hand extremity to the right hand extremity of said reflector when a rim of said reflector is placed in the horizontal plane said is in the range of 13×A to 14×A portion;

(14) the focal length of segment 21 is A and the focal length of segment 23 is in the range of 1.06×A to 1.16×A;

(15) the focal length of segment 21 is A and the focal length of segment 25 is in the range of 1.5×A to 1.7×A;

(16) the total or maximum parabolic length of curvature (see FIG. 4) of the areas 3 and 5 combined in the range of 6×A to 8.2×A.

Another advantage of the present invention is that the construction of the tri-parabolic surface main reflector 8 will continue to operate to produce the advantages mentioned above, as lamp technology improves, and lamps become a better point source of light. The latest technology in lamps is the reduced arc metal halide lamps. Other small arc lamps can also operate effectively with the tri-parabolic surface main reflector 8. Other lamps which may also work with the reflector 8 include high pressure sodium lamps and conventional long arc tubular lamps. Whilst a reduced arc metal halide lamp or other small arc lamp is the preferred type to be used with the reflector of the present invention, older lamps which do not emit light from as defined a point as the above lamps, may achieve a variation in the results by comparison to small arc lamps.

Illustrated in FIG. 7, are dash lines 121, 123 and 125 are the respective unused sections of the parabolic segments 21, 23 and 25 and are illustrated for the purpose of helping to show the derivation of the reflector shape. Between adjacent part parabolic portions for example such as 21 and 23 if tangents are drawn to these curves at their theoretical or mathematical point of intersection (in the region of the change over from one curve to the other), the tangents will have an angle between them of between 0° and 5°. The same will be the case for adjacent segments 23 and 25.

Illustrated in FIG. 8, are the test results of a computer simulation of a flood light having a reflector of the preferred embodiment described above with the focal length A or $F_1$ equal to 50 mm. The top and right hand axes have units of degrees, whereas the left and bottom axes have units of metres. In the simulation the flood light has a lamp of 1000 W which is a small arc metal halide lamp. The flood light is mounted so that the visor is in the horizontal plane, parallel to the ground to be lighted. The distance from the ground to the visor is 8 metres. All illuminance values are taken normal to the horizontal plane and on the horizontal plane. In the area approximately 13 metres away from the flood light 2 and to 5 metres either side thereof, the maximum illuminance is indicated as being 255 lux, whereas at the edge of the area, it is indicated as 200 lux. This data, in the area, generates an average lux of some 225 lux, and thus the variation for the highest to the lowest from the average is plus or minus 10%. This area, is bounded from between the −10 degree line (10 degrees in the rearward direction) and just under 60 degrees in the forward direction.

Figure 9:
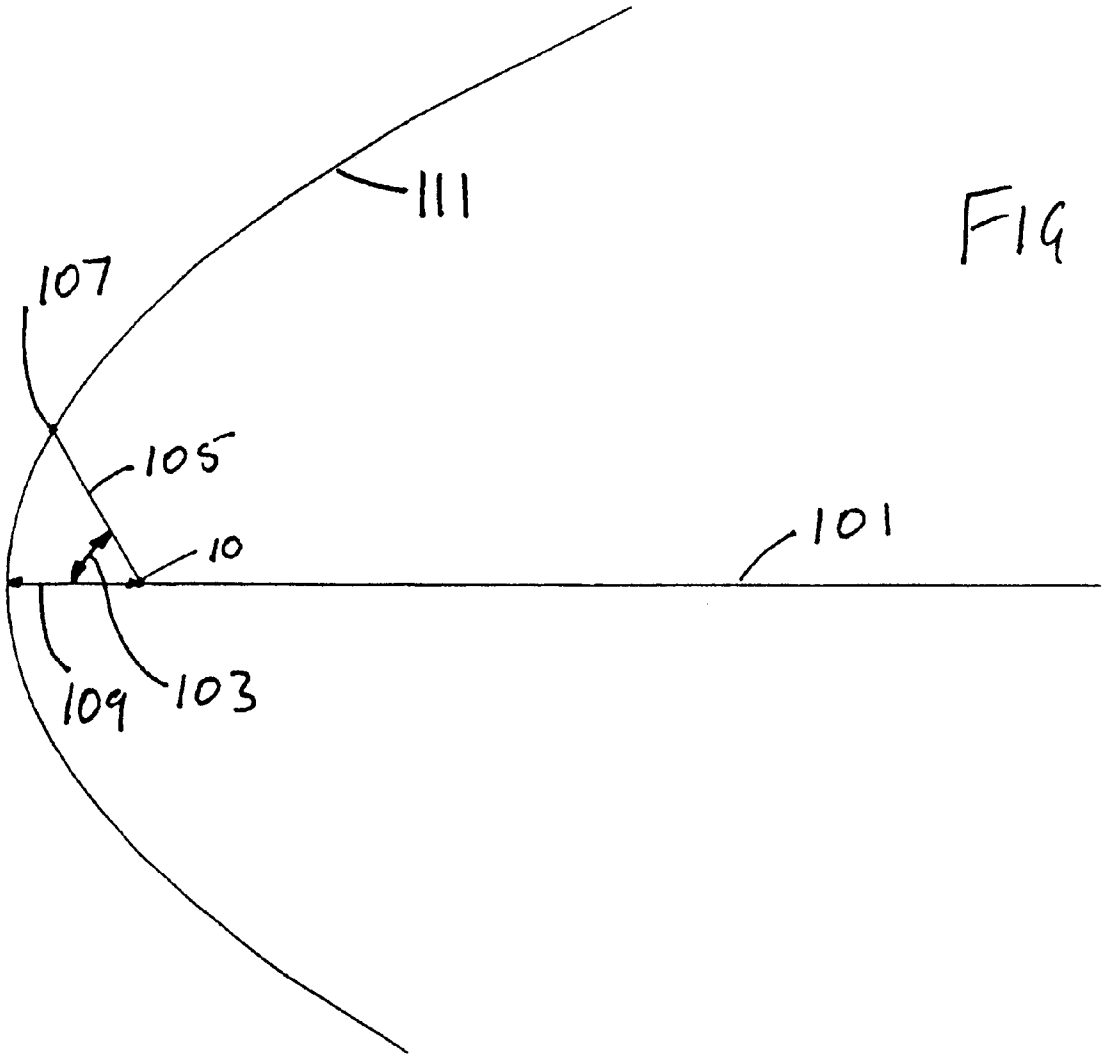
FIG. 9 is a graphical representation of the parameters to construct a parabola.

The parabolic shapes of the reflector 8 are derived from the formula r=(2*F)/(1+Cos Ø), where r=the straight line distance (see item 105 in FIG. 9) between the focal point 10 to a point (see point 107 in FIG. 9) on the curve (see item 111 in FIG. 9); F=focal length (see item 109 in FIG. 9); and Ø=angle (see item 103 in FIG. 9) between the major axis (see item 101 in FIG. 9) and the focal line represented by the distance r.

The foregoing describes a reflector 8 having three different types of reflective sheeting. However, a second embodiment of the present invention is substantially identical to the flood light 2, except that the area 3 which has spectral reflective sheeting is replaced by a reflective sheeting of the type that area 5 is made from. Thus in this second embodiment only the concave peened or concentrating reflective sheeting is used for areas 3 and 5, and convex or concentrating reflective sheeting are used elsewhere. This embodiment will not produce the same level of evenness of illuminance as the embodiment of FIG. 4, but when used in combination with the embodiment of FIG. 4 is able to produce a resultant illumination that has a broader luminous intensity distribution than that of the embodiment of FIG. 4. This broader illumination intensity distribution allows the flood light of the second embodiment to combine well with that of embodiment of FIGS. 1 to 3, should the illumination pattern require overlapping.

In a third embodiment, the reflector 8 as described above can be modified by having all the surfaces with one type of reflecting sheeting, being specifically the convex or concentrating type of reflecting sheeting. This third embodiment will maintain the cut off characteristics of other embodiments.

The flood light 2 depicted in the figures is able to be used in a variety of orientations. However, for the purposes of illustration it is illustrated such that the plane of the rim of the reflector is in the horizontal plane. Thus, any directions or lines normal to the plane of the rim as illustrated in the figures will be in the vertical. While in the above description the expression "angles to the vertical" is used in relation to features of the reflector, it will be understood that if the plane of the rim is not in the horizontal, the angles referred to will be angles to a direction which is normal to the plane of the rim.

The foregoing describes a reflector having three part parabolic segments, however, the benefits of the invention could also be obtained from a reflector having more than three part parabolic segments. The disadvantage of more than three part parabolic segments is that it will make the reflector more difficult to form, and more complex. Three part parabolic segments is thought to be a good compromise between function and manufacturing cost.

The foregoing describes one embodiment of the present invention and modifications obvious to those skilled in the art can be made thereto without departing from the scope of the present invention.

What is claimed is:

1. A reflector having at least three segments, each segment having a part parabolic shape in cross-sectional side elevation, each segment having their respective part parabolic shape of uniform width and also segments having a common focal line, said parabolic segments each reflecting a parallel beam of light that originates from a source located in, or as close as possible to, said focal line, wherein a first segment has a part parabolic portion which has the smallest focal length of said at least three segments and beginning at one rim of said reflector and whereby each successive segment has a longer focal length by comparison to the previous segment.

2. A reflector as claimed in claim 1 wherein a first segment has a part parabolic portion which has the smallest focal length of all segments and beginning at one rim at the rear of said reflector.

3. A reflector as claimed in claim 1 wherein said reflector has only three segments with the third segment terminating at a rim at a front of said reflector.

4. A reflector as claimed in claim 3 wherein the change over from the first to second segment occurs at an angle of between 0 to 10 degrees to the vertical measured at a common focal line, and the changeover from the second segment to the third segment occurs at some 50 to 80 degrees to the vertical measured at the common focal line.

5. A reflector as claimed in claim 3 wherein the first segment reflects a main beam at an angle of between some 55 to 65 degrees from the vertical, the second segment reflects a main beam at an angle of some 45 to 55 degrees from the vertical, and the third segment reflects a main beam at an angle of some 25 to 45 degrees from the vertical.

6. A reflector as claimed in claim 4 wherein each of said change overs between adjacent segments is such that tangents to adjacent part parabolic portions at a theoretical point of intersection have an angle between the tangents of between 0° and 5°.

7. A reflector as claimed in claim 1 wherein said reflector includes two planar sides which taper from respective side rims of said reflector towards the opposite end of said reflector, each planar side being tapered at an angle of between 15 to 18 degrees to a direction normal to a plane in which lie.

8. A reflector as claimed in claim 1 wherein the focal length ratio of the first segment to the second segment to the third segment, if the focal length A of the first segment is the smallest focal length of the parabolic segments, is A:1.11× A:1.58×A, respectively.

9. A reflector as claimed in claim 1 wherein all the reflective surfaces comprising the segments of said reflector are comprised of either spreading or convex peened reflective sheeting.

10. A reflector as claimed in claim 1 wherein a band of said reflector of predetermined width and length is located centrally relative to the width of said reflector, said band being comprised of either concentrating or concave peened reflective sheeting, with the rest of the reflective surfaces comprising the segments of said reflector being comprised of either spreading or convex preened reflective sheeting.

11. A reflector as claimed in claim 1 wherein a band of said reflector of predetermined width and length is located centrally relative to the width of said reflector, said band having a first part comprised of specular reflective sheeting and a second part comprised of either concentrating or concave peened reflective sheeting, said first part occupying an area of said band from a rim of said reflector to an intermediate location of said reflector and said second part occupying the rest of said band, with the rest of the reflective surfaces of said reflector being comprised of either spreading or convex peened reflective sheeting.

12. A reflector as claimed in claim 10 wherein the parabolic length of curvature occupied by said band is 6.2 to 8.2 times the focal length of the shortest focal length parabolic portion.

13. A reflector as claimed in claim 11 wherein said first part has a parabolic length of curvature of 3.3 times to 4.5 times the focal length of the shortest focal length parabolic portion.

14. A reflector as claimed in claim 11 wherein the parabolic length of curvature of said second part is 2.8 to 3.9 times the focal length of the shortest focal length parabolic portion.

15. A reflector as claimed in claim 11 wherein the width of the first and or second parts is or are one of the following: approximately 2.5 to 3.5 times the focal length of the shortest focal length parabolic portion; the same and both are approximately 2.5 to 3.5 times the focal length of the shortest focal length parabolic portion; and approximately one third of the total width of said reflector.

16. A reflector as claimed in claim 1 wherein:

a) the maximum height of said reflector above a rim of said reflector is in the range of 4.3 to 5.3 times the focal length of the shortest focal length parabolic portion;

b) the width of the opening of the reflector at its rim is some 9.1 to 11 times the focal length of the shortest focal length parabolic portion;

c) the length of said reflector is approximately 13 to 14 times the focal length of the shortest focal length parabolic portion, measured between two parallel lines perpendicular to the plane of said rim, respective ones of said perpendicular lines passing through a forward extremity and a rearward extremity of the reflector, d) the length of the opening of said reflector measured from rim to rim is 12 to 13.8 times the focal length of the shortest focal length parabolic portion.

17. A reflector as claimed in claim 1 wherein a visor encloses the volume of said reflector.

18. A reflector as claimed in claim 17 wherein when light hits said visor at between 50 to 65 degrees from the vertical, it will reflect approximately 33% of the light intensity.

19. A reflector as claimed in claim 1 wherein a lamp used with said reflector is of the reduced arc halide metal lamp type.

20. A reflector as claimed in claim 1 wherein a visor comprised of a glass or plastics material is at the terminus of said reflector.

21. A reflector as claimed in claim 10, wherein said reflector has the following dimensional features:

a) the parabolic distance occupied by said first is 3.8 times the smallest focal length of said parabolic segments;

b) the parabolic distance occupied by said second part is 3.4 times the smallest focal length of said parabolic segments;

c) the width of said band is approximately 3 times the smallest focal length of said parabolic segments;

d) the perpendicular maximum height of said reflector above the plane of a rim of said reflector, is approximately 4.8 times the smallest focal length of said parabolic segments;

e) the width of the opening of said reflector at its rim is some 9.6 times the smallest focal length of said parabolic segments;

f) the perpendicular distance between a perpendicular line to a plane which includes a rim of said reflector, said perpendicular line being a tangent to said reflector at the reflector's left hand extremity and a second line parallel to said perpendicular line though a the right hand extremity of said reflector, is thirteen to fourteen times the smallest focal length of said parabolic segments;

g) the length of the opening of the reflector at its rim is 12.9 times the smallest focal length of said parabolic segments.

22. A reflector as claimed in claim 1 wherein said reflector includes two side reflectors having two planar sufaces which taper from respective side rims of said reflector towards the opposite end of said reflector, each planar surface being at 16.5 degrees to a direction normal to a plane in which lie said rims.

23. A reflector as claimed in claim 11 wherein the reflective surface of said reflector, including the side surfaces, which is not occupied by the first and second parts, is comprised of spreading or convex peened reflecting sheeting.

24. A floodlight comprising the reflector as claimed in claim 1 wherein said reflector is assembled into a flood light housing.

25. A floodlight as claimed in claim 24 including a visor enclosing the volume of said reflector to reflect light onto the reflective surface thereof, said flood light being characterised by having at least three main beams reflected from a light source off each of the parabolic segments and fill light directly from said light source, and wherein additional fill light is provided by means of light reflected from said visor subsequently being reflected from said parabolic segments and out through said visor, said flood light producing defined cut offs in at least the forward and rearward directions.

26. A floodlight as claimed in claim 25 wherein said floodlight also has defined cut offs on the sides thereof.

* * * * *